US009003786B2

(12) United States Patent
Bacon et al.

(10) Patent No.: US 9,003,786 B2
(45) Date of Patent: Apr. 14, 2015

(54) PRESSURE LIMITING IN HYDRAULIC SYSTEMS

(75) Inventors: Kevin A. Bacon, Peoria, IL (US); Jason L. Brinkman, Peoria, IL (US); Timothy L. Hand, Metamora, IL (US); Randall A. Harlow, Brimfield, IL (US)

(73) Assignee: Caterpillar Inc., Peoria, IL (US)

( * ) Notice: Subject to any disclaimer, the term of this patent is extended or adjusted under 35 U.S.C. 154(b) by 949 days.

(21) Appl. No.: 13/104,049

(22) Filed: May 10, 2011

(65) Prior Publication Data

US 2012/0285158 A1 Nov. 15, 2012

(51) Int. Cl.
*F15B 11/16* (2006.01)

(52) U.S. Cl.
CPC ..... *F15B 11/168* (2013.01); *F15B 2211/30555* (2013.01); *F15B 2211/6058* (2013.01); *F15B 2211/653* (2013.01); *F15B 2211/654* (2013.01)

(58) Field of Classification Search
CPC ..... F15B 13/026; F15B 2211/465; F15B 2221/50572; F15B 2221/40553; F15B 2221/40561
USPC ..... 60/420, 422, 459; 91/444, 445, 446, 91/447, 448
See application file for complete search history.

(56) References Cited

U.S. PATENT DOCUMENTS 4,066,006 A * 1/1978 Heiser ..... 91/447
4,787,294 A * 11/1988 Bowden ..... 91/447
5,067,389 A * 11/1991 St. Germain ..... 60/427
5,077,972 A * 1/1992 Bianchetta et al. ..... 60/427
5,138,837 A * 8/1992 Obertrifter et al. ..... 60/426
5,289,679 A * 3/1994 Yasuda ..... 60/422
5,579,642 A * 12/1996 Wilke et al. ..... 60/426
5,699,665 A * 12/1997 Coolidge ..... 60/426
6,318,079 B1 * 11/2001 Barber ..... 60/422

FOREIGN PATENT DOCUMENTS

JP 57177405 11/1982
JP 06117406 4/1994
JP 08200306 8/1996

* cited by examiner

*Primary Examiner* — Thomas E Lazo

(57) ABSTRACT

This disclosure provides for pressure limiting a hydraulic system to a desired pressure value by a particular circuit by controlling and closing the compensator when the desired pressure setting is achieved. Closing the compensator will reduced the pressure head and flow in the circuit resulting in improved efficiency. One illustrated embodiment of the disclosure provides a relief valve in the pilot signal for a compensator. The method relates to limiting the pressure on an open side of the compensator, such that the pressure on the other side closes the compensator thereby limiting the pressure and also flow in the hydraulic circuit. In other words, the pressure on the open side is limited by the relief valve. Thus, the pressure on the other side increases thereby regulating the flow and pressure through the compensator.

In another embodiment of the disclosure, instead of reducing the pressure on the open side, the pressure on the closed side is increased, thereby controlling the flow and pressure of the hydraulic circuit. The pressure can be increased by a pump or any other suitable mode.

5 Claims, 2 Drawing Sheets

PRESSURE LIMITING IN HYDRAULIC SYSTEMS

TECHNICAL FIELD

The present disclosure relates to pressure limiting the hydraulic circuits, and more particularly to controlling the pilot signal pressure of the compensator.

BACKGROUND

This disclosure relates generally to hydraulic systems, and more particularly, but not exclusively, this disclosure relates to a method and system to control the flow and pressure in a hydraulic system.

With the advancement in the field of hydraulics, there has been an interest in development of a hydraulic system capable of performing a plurality of functions efficiently. One of the basic functions is too regulate the pressure and flow of the fluid passing through the hydraulic system. It is relatively common requirement, for hydraulic post compensated implement systems, to limit work port pressure to a value below the maximum system pressure. This requirement is typically met by adding work port relief valves, however the work port relief valves result in high flow losses and therefore reduces the efficiency. In another method, pre-pressure compensated circuits can also be used in a similar method to limit pressure. While various hydraulic compensators have been developed, there is still room for improvement. Thus, a need persists for further contributions in this area of technology.

SUMMARY

This disclosure provides for removing the work port relief valves used in the prior art to control the pressure. The pressure is limited in a particular circuit by controlling and closing the compensator when the desired pressure setting is achieved. As the compensator closes flow will be reduced in the circuit resulting in improved efficiency. One illustrated embodiment of the disclosure provides a relief valve in the pilot signal for a compensator. The method relates to limiting the pressure on the open side of the compensator, such that the pressure on the other side closes the compensator thereby limiting the pressure and also flow in the hydraulic circuit. In other words, the pressure on the open side is limited by the relief valve. Thus, the pressure on the other side increases thereby regulating the flow and pressure through the compensator. In another embodiment of the disclosure, instead of reducing the pressure on the open side, the pressure on the closed side is increased, thereby controlling the flow and pressure of the hydraulic circuit. The pressure can be increased by a pump or any other suitable source of external pressure.

DETAILED DESCRIPTION

Figure 1:
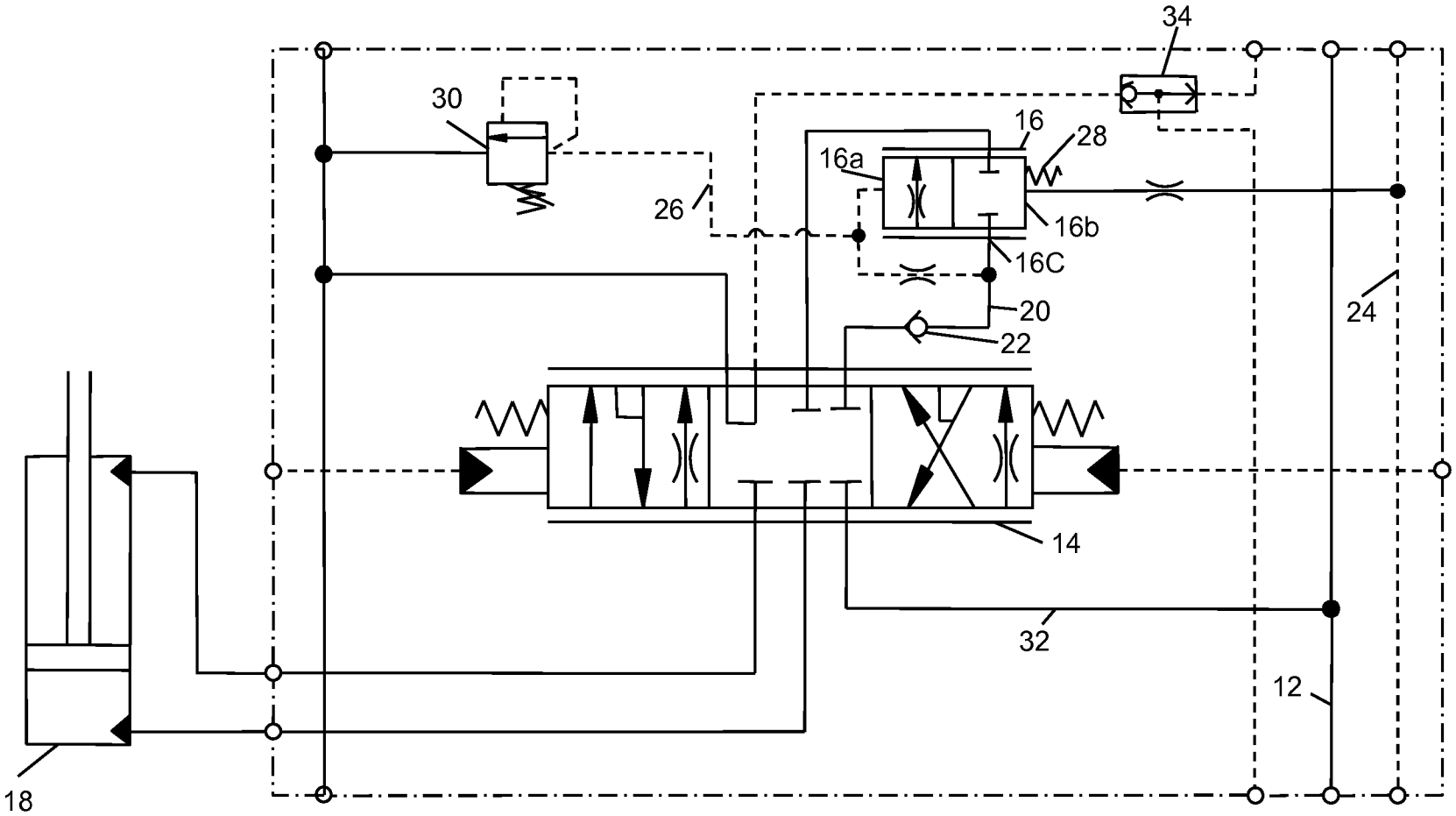
FIG. 1 is a schematic illustration of a first embodiment of the present invention.

A compensated hydraulic system 100 according to one illustrative embodiment of the current disclosure is shown in FIG. 1. The hydraulic system 100, can be used for example in machines such as track type tractors, wheel loader or similar equipment (not shown), for bucket or blade lifting systems, includes a source of hydraulic fluid such as a pump 12, an operational valve 14 and a pressure compensator 16 or a compensator valve 16, and a hydraulic actuator assembly 18. The pump 12 is configured to provide hydraulic fluid at a pressure head. The pressurized fluid from the pump 12 is pumped through the hydraulic system 100 to a load or to perform various functions by using the hydraulic actuator assembly 18. In this embodiment the hydraulic actuator assembly 18 is a piston cylinder arrangement 18. Further, in this embodiment the operational valve 14 is a control spool 14. The control spool 14 is configured to control the direction of the piston cylinder arrangement 18. In other words the, the control spool 14 directs the hydraulic fluid to the piston cylinder arrangement 18 to expand or retract the pistons. It should be appreciated that the hydraulic system 100 includes only one control spool 14 according to an embodiment of the disclosure. However, plurality of operational valves or control spools can be provided in a circuit as per the requirement in the circuit. Further, the system 100 is shown to include the compensator 16. The compensator 16 is arranged on the top of the control spool 14. The compensator 16 is provided to maintain a constant pressure drop across the control spool 14. The compensator 16 has two inlets, first inlet 16*a* and a second inlet 16*b*. The first inlet 16*a* is located on the open end of the compensator 16. The first inlet 16*a* is subjected to pressure tending to open the compensator and thereby allow the flow of hydraulic pressure. The second inlet 16*b* is located at the closed end of the compensator 16. The second inlet 16*b* is subjected to a spring force and additional pressure sources (if any) to close the opening of the compensator, thereby limiting the flow of hydraulic fluid. The term first inlet 16*a* and open end 16*a* have been used interchangeably in the description and refer to the same inlet/same end of the compensator 16. The term second inlet 16*b* and closed end 16*b* have been used interchangeably in the description and refer to the same inlet/same end of the compensator 16.

The control spool 14 can control the direction of the fluid to direct the hydraulic fluid to expand or retract the cylinder piston arrangement 18. Further, the compensator 16 is provided to maintain a constant pressure drop across the control spool 14.

Further, the hydraulic system 100 can include a supply line 20 connecting the control spool 14 with an inlet 16*c* of the pressure compensator 16 through a load drop check valve 22. The load drop check valve 22 prevents the backflow of fluid to the control spool 14 when the pump 12 is not functioning. The inlet 16*c* is connected to the supply line 20 from the pump 12.

The hydraulic system 100 further includes a first signal line 24 and a second signal line 26. The first signal line 24 is located upstream of control spool 14. The first signal line 24 provides the fluid pressure head, and allows the hydraulic fluid to bias the spool member (not shown) of the control spool 14 through the closed end 16*b* of compensator 16. The first signal line 24 on the closed side 16*b* tends to close the compensator 16. The first signal 24 act in the same direction of the compensator spring 28 tending to close the compensator 16.

The second signal line 26 is connected with the open end 16*a* of the compensator 16 and allows flow of fluid, to bias the pressure compensator 16 in the opposite direction of compensator spring 28 and the first signal line 24. The second signal line 26 is located on the open side 16*a* of the compensator and tends to open the compensator 16. The second signal line 26 works opposite to the force of the first signal line 24 on the closed end 16*b* and the compensator spring 28.

Further, the hydraulic system 100 includes a regulating valve 30. In this embodiment, the regulating valve 30 is essentially a pressure relief valve. The pressure relief valve 30 is arranged at the open side 16*a* of the compensator 16 in the second signal line 26. Thus, the relief valve 30 is arranged on the pilot passage 26 which is tending to open the compensator.

Accordingly, an increase in the pressure in the second signal line 26, in the open side 16*a* of the compensator 16, is limited to pressure value set by relief valve 30. Consequently, the pressure tending to open the compensator 16 is limited to a desired pressure value set through the relief valve 30. Thus limiting the pressure on the open side 16*a*, relatively causes the pressure from the first signal line 24 and the compensator spring 28 to increase and close the compensator 16. This leads to controlling of both the pressure and the flow of the hydraulic fluid in the circuit 100 when the pressure in the signal line 26 increases beyond the set threshold value of the relief valve 30.

To provide a better understanding, consider the scenario, where the pump 12 is provided with a pump inlet line 32 leading to the control spool 14. The pressure from the pump 12 is passed to the compensator 16 from the control spool 14, and the supply line 20. Further, the system is shown to include a check valve 34 which is connected to the actuator 18. The check valve 34 acts as a sensor for determining the load condition of the actuator 18 during expansion or retraction.

Downstream the control spool 14, the supply line 20 is subjected to the relief valve 30 through the second signal line 26. Pressure in the supply line 20 tends to open the compensator thereby allowing flow of hydraulic fluid through the control spool 14. The pressure line 20 is subjected to the relief valve 30, which operates beyond a set pressure threshold. Thus, when the pressure exceeds the desired pressure value or the set pressure threshold of the relief valve 30, the relief valve 30 opens and drains the hydraulic fluid to a reservoir/tank. This results in decrease in the pressure of the hydraulic fluid on the open side 16*a* of the compensator 16. Thereby, relatively increasing the pressure from the first signal line 24 and the compensator spring 28 and allowing the combined force of the spring 28 and the pressure from the first signal line 24 on the closed side 16*b* to close the compensator 16.

Therefore, such arrangement results in pressure limiting and leads to control of pressure head and the flow of the hydraulic fluid without affecting the other function of the hydraulic system 100. In other words, the system is more efficient as it provides the pre-compensated control of the pressure and the flow to the cylinder piston arrangement 18.

Figure 2:
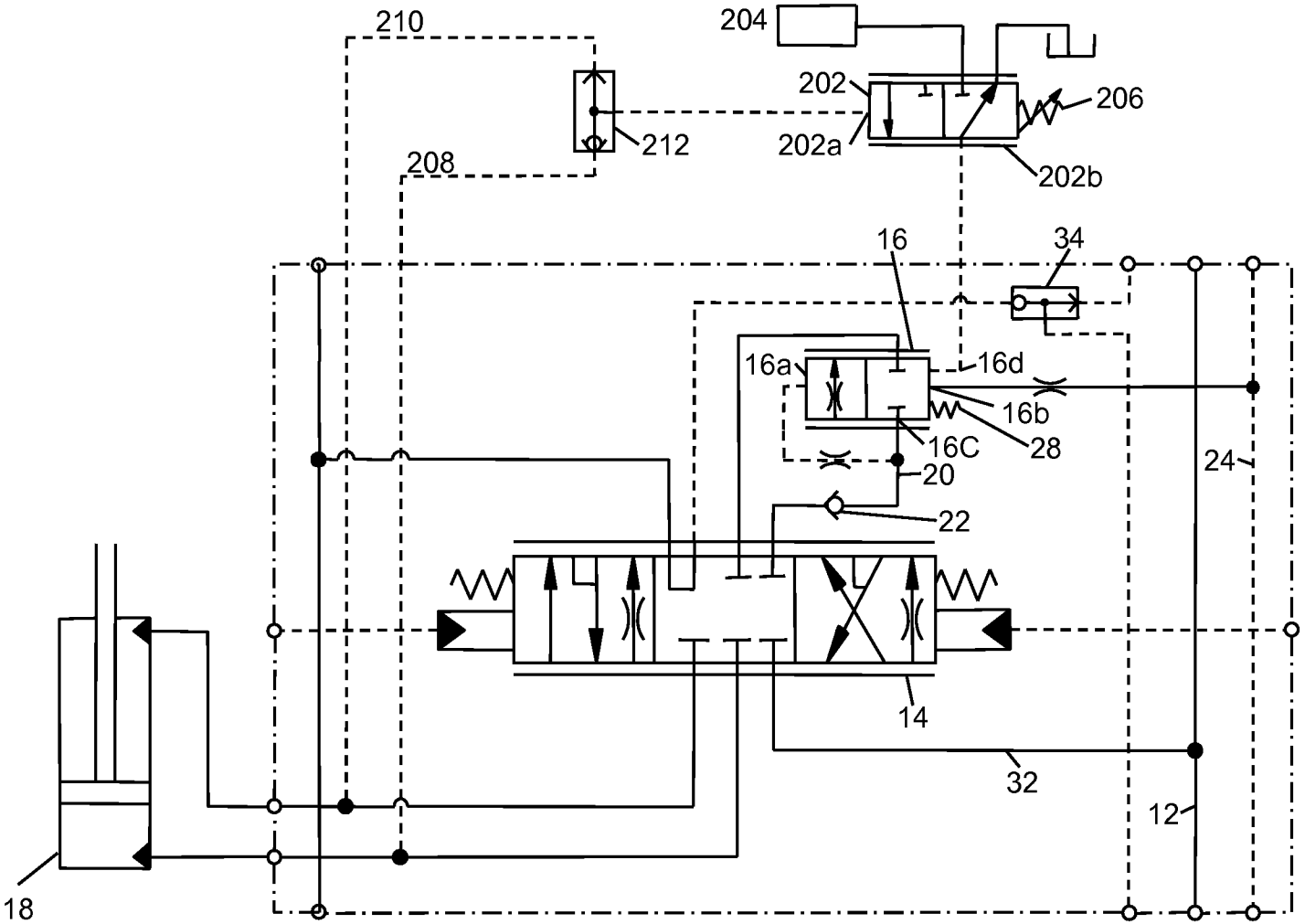
FIG. 2 is a schematic illustration of a second embodiment of the present invention.

FIG. 2 is a schematic illustration of a hydraulic system 200 in a second embodiment of the present invention. The hydraulic system 200 is similar to the hydraulic system 100 as described in FIG. 1. However, the hydraulic system 200 does not include the relief valve 30. Instead, the hydraulic system 200 includes a pressure controlling means. In this embodiment, the pressure controlling means includes a control valve 202 and external pressure source 204. In an embodiment, the pressure control valve 202 can be electronically controlled or mechanically controlled, as shown.

The control valve 202 has an open side 202*a* and closed side 202*b*. The open side 202*a* is subjected to a pressure tending to open the flow through the control valve 202 from pressure source 204, whereas the closed side 202*b* is subjected to a spring pressure tending to close the flow from pressure source 204 through the control valve 202. The control valve 202 is connected to direct the fluid from the external source 204 towards the closed end 16*d* of the compensator 16. In other words, the control valve 202 causes the pressure from the pressure source 204 to act in the same direction of the compensator spring 28. Further, the control valve 202 includes a control spring 206, which is tending to close the control valve 202. It is to be noted that the external pump can be any suitable pressure source 204.

Furthermore, the control valve 202 is operated based on the signal from the signal line 208 and 210. The signal line 208 and 210 are connected to the opens side 202*a* of the control valve 202. The signal lines 208 and 210 are connected through a check valve arrangement 212. The signal line 208 and 210 senses the fluid pressure in the piston cylinder arrangement 18 during expansion and retraction, respectively. The signal line 208 and 210 signals the increase in pressure on the work side of the piston cylinder arrangement 18 to the open side 202*a* of the control valve 202, through the check valve 212.

In the current arrangement, the signal from the signal line 208 or 210 during expansion or retraction is passed to the open side 202*a* of the control valve 202. The pressure signal from the signal line 208 or 210 tends to open the control valve 202 against the force of the control spring 206. Thereby, connecting the pressure from the pressure source 204 with the closed side 16*d* of the compensator 16. The increase in pressure on the closed side 16*d* leads to closing of the compensator thereby controlling the pressure and flow of hydraulic fluid through the control spool 14. Consequently, the pressure in the cylinder piston arrangement 18 is reduced and controlled. Vice-versa, any decrease in the pressure in the pressure signal line 208 or 210 causes the closing of the control valve 202, thereby disconnecting the pressure source 204 with the closed side 16*d* of the compensator 16. This leads to relative decrease in pressure on the closed side 16*d* of the compensator and hence the pressure on the open side 16*a* of the compensator opens the compensator and increase the flow through the control spool 14.

Thus as compared to FIG. 1, the embodiment described in FIG. 2, increases the pressure on the closed side 16*d* of the compensator 16 to control the pressure and flow in the hydraulic fluid.

To summarize, first embodiment as described in FIG. 1 is configured to reduce the pressure on the open side 16*a* of the compensator 16, whereas the second embodiment as described in FIG. 2, senses the pressure in the piston cylinder arrangement 18 and accordingly, controls the compensator by providing an additional pressure on the closed side 16*b* of the compensator 16.

It is to be noted the hydraulic system 100 or hydraulic system 200 as described above can be used in any hydraulic circuit, such as circuits in hydraulic machine, loader, tractors, backhoe loaders, wheel loader, mine trucks, and the like.

Industrial Applicability

The hydraulic system 100 described above provides for improvement in capability of pressure limiting a hydraulic circuit without significant losses. The system 100 provides for utilizing the compensator 16 to pressure limit and at the same time minimizing the flow losses. The disclosed hydraulic system 100 includes a regulating valve 30. The regulating valve 30 is configured to pressure limit the hydraulic system 100 by controlling the pilot signal which is tending to open the compensator 16. For a better understanding, consider a scenario, where the system 100 is supplied with high pressure hydraulic fluid from the pump 12. High hydraulic pressure, beyond the safety limits, can cause damage to the hydraulic machinery, such as it may cause damage to the seals and piston rings in the actuators 18. Thus, it is mandatory to limit the maximum hydraulic pressure in the system 100. The disclosed system 100 provides for controlling the opening aperture of the compensator 16 as compared to releasing the extra pressure through a relief valve. Thus, in any hydraulic system, the energy generated from the pump 12 is not wasted by releasing the pressure through the relief valve, but the energy is controlled by controlling the compensator 16.

As described above, a relief valve 30 is hydraulically connected to the pilot signal line 20 of the compensator 16. The pilot signal which is tending to open the compensator is subjected to the regulating valve 30. The regulating valve 30 is configured to relieve the additional pressure beyond a set limit. Thus, the regulating valve 30 regulates the pressure in the pilot signal line 20. Therefore, when the pressure in the hydraulic circuit increases beyond a safety limit, the regulating valve 30 opens and reduces the pressure on signal line tending to open the compensator 16, which in turn allows the pressure 24 and the spring force 28 tending to close the compensator to close the compensatory. Hence, the flow rate and the pressure through the compensator is controlled and the pressure in the hydraulic system 100 is controlled. Such system provides for controlling the pressure from the pump instead of wasting the work done by the pump 12 through a safety release valve.

In an alternate embodiment, to achieve the same objective, instead of reducing the pressure on the side tending to open the compensator, the pressure on the side tending to close the compensator is boosted. As described above, it is required to maintain a safety limit of the pressure in the hydraulic circuit. In this embodiment, an additional pressure source 204 is provided in the system 200. The pressure source can be any suitable source already present in the system 200. The pressure source 204 is connected through a control valve 202. The control valve on one side is connected with the pressure line for expanding and contracting the actuators 18. On the other side the control valve 202 is biased by the spring 206. Any increase in pressure beyond a set limit on the side of pressure line is sensed and is transmitted to the control valve 202. Thus the control valve 202 connects the pressure source 204 to the side 16*d* of the compensator 16. The pressure from the pressure source 204 together with the spring force 28 closes the compensator, thereby reducing the flow rate and pressure of hydraulic fluid through the spool 14. In an alternate embodiment, the control valve 202 can be controlled electronically by using strain gauges and other suitable pressure sensors.

In summary, the hydraulic system 100 is disclosed for automatically pressure limiting any hydraulic circuit without energy loss from the pump and minimal flow losses. The system 100 is configured to control both the flow rate and pressure through the compensator 16 by controlling the opening and closing of the compensator 16 by sensing the pressure in the actuation line.

Aspects of this disclosure may be applied to any hydraulic circuit, specifically in hydraulically circuits drawing power driven by engines, as increase in engine speed can speed the pump thereby resulting in continuous fluctuation in the pressure. Aspects of this disclosure may also be applied to hydraulic system in machines such as excavators, track type tractors, backhoe loaders, wheel loaders, pipe layers, compactors, and trucks. Although the embodiments of this disclosure as described herein may be incorporated without departing from the scope of the following claims, it will be apparent to those skilled in the art that various modifications and variations can be made. Other embodiments will be apparent to those skilled in the art from consideration of the specification and practice of the disclosure. It is intended that the specification and examples be considered as exemplary only, with a true scope being indicated by the following claims and their equivalents.

What is claimed is:

1. A hydraulic circuit to control the flow of pressurized fluid from a pump to a hydraulic actuator assembly comprising:

a plurality of operational valves provided in a supply line of the pump;

a pressure compensator connected between an operational valve and the hydraulic actuator assembly, adapted to feed fluid from the pump to the hydraulic actuator assembly, the pressure compensator having a first inlet and a second inlet, the first inlet connected to the supply line from the pump adapted to open the compensator by the fluid pressure, and the second inlet connected to a load sense line and a spring adapted to apply pressure in a direction to close the compensator;

an external pump configured to apply pressure at the second inlet to close the compensator when the load sense line senses a predefined pressure value inside the compensator thereby limiting the pressure and the flow of the fluid;

a control valve disposed between the external pump and the second inlet, configured to direct selective flow from the external pump to the second inlet; and a valve coupled to a first signal line in communication with a first chamber of the hydraulic actuator assembly, and a second signal line in communication with a second chamber of the hydraulic actuator assembly, wherein the valve is configured to communicate one of a pressure signal of the first and second signal line to the control valve, wherein the control valve is movable between positions based on the pressure signal.

2. The hydraulic circuit of claim 1 further includes a plurality of sensors present on the supply line and the load sense line to sense the pressure of the flowing fluid.

3. A hydraulic circuit to control the flow of pressurized fluid from a pump to a hydraulic actuator assembly comprising:

a plurality of operational valves provided in a supply line of the pump;

a pressure compensator connected between an operational valve and the hydraulic actuator assembly, adapted to feed fluid from the pump to the hydraulic actuator assembly, the pressure compensator having a first inlet and a second inlet, the first inlet connected to the supply line from the pump adapted to open the compensator by the fluid pressure, and the second inlet connected to a load sense line and a spring adapted to apply pressure in a direction to close the compensator;

a pressure controlling means configured to apply pressure at the second inlet to close the compensator when the load sense line senses a predefined pressure value inside the compensator thereby limiting the pressure and the flow of the fluid, wherein the pressure controlling means is electronically controlled, wherein the pressure controlling means includes an external pressure source and an electronically controlled control valve are disposed between the external pressure source and the second inlet, the electronically controlled control valve configured to direct selective flow from the external pressure source to the second inlet; and pressure sensors associated with each of a first chamber and a second chamber of the hydraulic actuator assembly, wherein the electronically controlled control valve is movable between positions based on the pressure of the first and second chambers.

4. The hydraulic circuit of claim 3, wherein the external pressure source includes an external pump.

5. The hydraulic circuit of claim 3 further includes a plurality of sensors present on the supply line and the load sense line to sense the pressure of the flowing fluid.

* * * * *

UNITED STATES PATENT AND TRADEMARK OFFICE

CERTIFICATE OF CORRECTION

PATENT NO. : 9,003,786 B2
APPLICATION NO. : 13/104049
DATED : April 14, 2015
INVENTOR(S) : Bacon et al.

It is certified that error appears in the above-identified patent and that said Letters Patent is hereby corrected as shown below:

In the specification

Column 4, line 51, delete "Industrial Applicability" and insert -- INDUSTRIAL APPLICABILITY --.

Signed and Sealed this
Eighth Day of March, 2016

Michelle K. Lee

Michelle K. Lee
*Director of the United States Patent and Trademark Office*